US007722334B2

(12) United States Patent
Kim

(10) Patent No.: US 7,722,334 B2
(45) Date of Patent: May 25, 2010

(54) COMPRESSOR AND OVERLOAD PROTECTING APPARATUS

(75) Inventor: Sung-Choon Kim, Busan (KR)

(73) Assignee: LG Electronics Inc., Seoul (KR)

( * ) Notice: Subject to any disclaimer, the term of this patent is extended or adjusted under 35 U.S.C. 154(b) by 439 days.

(21) Appl. No.: 10/497,153

(22) PCT Filed: Dec. 21, 2002

(86) PCT No.: PCT/KR02/02412

§ 371 (c)(1),
(2), (4) Date: May 28, 2004

(87) PCT Pub. No.: WO03/056183

PCT Pub. Date: Jul. 10, 2003

(65) Prior Publication Data

US 2005/0063828 A1 Mar. 24, 2005

(30) Foreign Application Priority Data

Dec. 22, 2001 (KR) ..... 10-2001-0083268

(51) Int. Cl.
*F04B 53/00* (2006.01)

(52) U.S. Cl. ..... 417/312; 419/902

(58) Field of Classification Search ..... 417/32, 417/410.5, 312
See application file for complete search history.

(56) References Cited

U.S. PATENT DOCUMENTS

| | | | | |
|---|---|---|---|---|
| 5,118,260 | A * | 6/1992 | Fraser, Jr. | 417/18 |
| 5,509,786 | A * | 4/1996 | Mizutani et al. | 417/32 |
| 2002/0006342 | A1 * | 1/2002 | Han | 417/312 |

FOREIGN PATENT DOCUMENTS

| | | | |
|---|---|---|---|
| CN | 1180792 | | 5/1998 |
| JP | 4-101093 | A | 4/1992 |
| JP | 6-17780 | A | 1/1994 |
| JP | 6-241178 | A | 8/1994 |
| JP | 7-189954 | A | 7/1995 |
| JP | 8-210277 | A | 8/1996 |

* cited by examiner

*Primary Examiner*—Devon C Kramer
*Assistant Examiner*—Patrick Hamo
(74) *Attorney, Agent, or Firm*—Birch, Stewart, Kolasch & Birch, LLP

(57) ABSTRACT

A compressor includes a suction unit for sucking fluid, a compression unit for compressing the fluid sucked through the suction unit, a discharge unit for discharging the fluid compressed in the compression unit, an electric mechanism unit connected to the compression unit and driving the compression unit, and an overload protecting apparatus installed at the discharge unit and stopping operation of the electric mechanism unit if a temperature of the fluid discharged through the discharge unit is higher than a pre-set temperature.

9 Claims, 2 Drawing Sheets

COMPRESSOR AND OVERLOAD PROTECTING APPARATUS

TECHNICAL FIELD

The present invention relates to a compressor and, more particularly, to an overload protecting therefore of a compressor for preventing an overload to a compressor.

BACKGROUND ART

A compressor, a device for sucking fluid and increasing pressure, is widely used for an air-conditioner, refrigerator, or the like. There are many kinds of compressors according to a driving method, including a reciprocating compressor, a scroll compressor and a turbo compressor, etc.

The compressor consists of a compression mechanism unit for performing compression of the fluid and a driving unit for driving the compression mechanism unit. The driving unit commonly uses a motor converting electric energy to kinetic energy.

An overload protecting apparatus for sensing heat generated from a rotor and a stator is installed near the motor. If an overheat is generated, the overload protecting apparatus stops driving of the motor so that the motor may not be damaged from the overload.

However, as for the overheating of the compressor, generally, the motor may be overloaded, and in addition, if the temperature of the discharged fluid is too high due to an abnormal operation, carbonization of oil, damage of parts and an unstable operation would cause degradation of a reliability of the compressor.

DISCLOSURE OF THE INVENTION

Therefore, an object of the present invention is to provide a compressor having an overload protecting apparatus that is capable of stopping operation of a motor not only when the motor is overheated but also when a temperature of a discharge fluid is too high due to an abnormal operation.

In order to achieve the above objects, there is provided a compressor including: a suction unit for sucking fluid; a compression unit for compressing the fluid sucked through the suction unit; a discharge unit for discharging the fluid compressed in the compression unit; an electric mechanism unit for driving the compression unit connected to the compression unit; and an overload preventing unit installed at the discharge unit for stopping operation of the electric mechanism unit if a temperature of the fluid discharged through the discharge unit is higher than a pre-set temperature.

MODE FOR CARRYING OUT THE PREFERRED EMBODIMENTS

The present invention will now be described with reference to accompanying drawings.

A compressor of the present invention includes: a suction unit for sucking fluid; a compression unit for compressing the fluid sucked through the suction unit; a discharge unit for discharging the fluid compressed in the compression unit; an electric mechanism unit for driving the compression unit connected to the compression unit; and an overload preventing unit installed at the discharge unit for stopping operation of the electric mechanism unit if a temperature of the fluid discharged through the discharge unit is higher than a pre-set temperature.

The compressor in accordance with the present invention can be any compressor regardless of kinds of compressors such as a piston type compressor, a scroll compressor, a turbo compressor, a so-called Z-type compressor and a reciprocating (linear) compressor.

Figure 1:
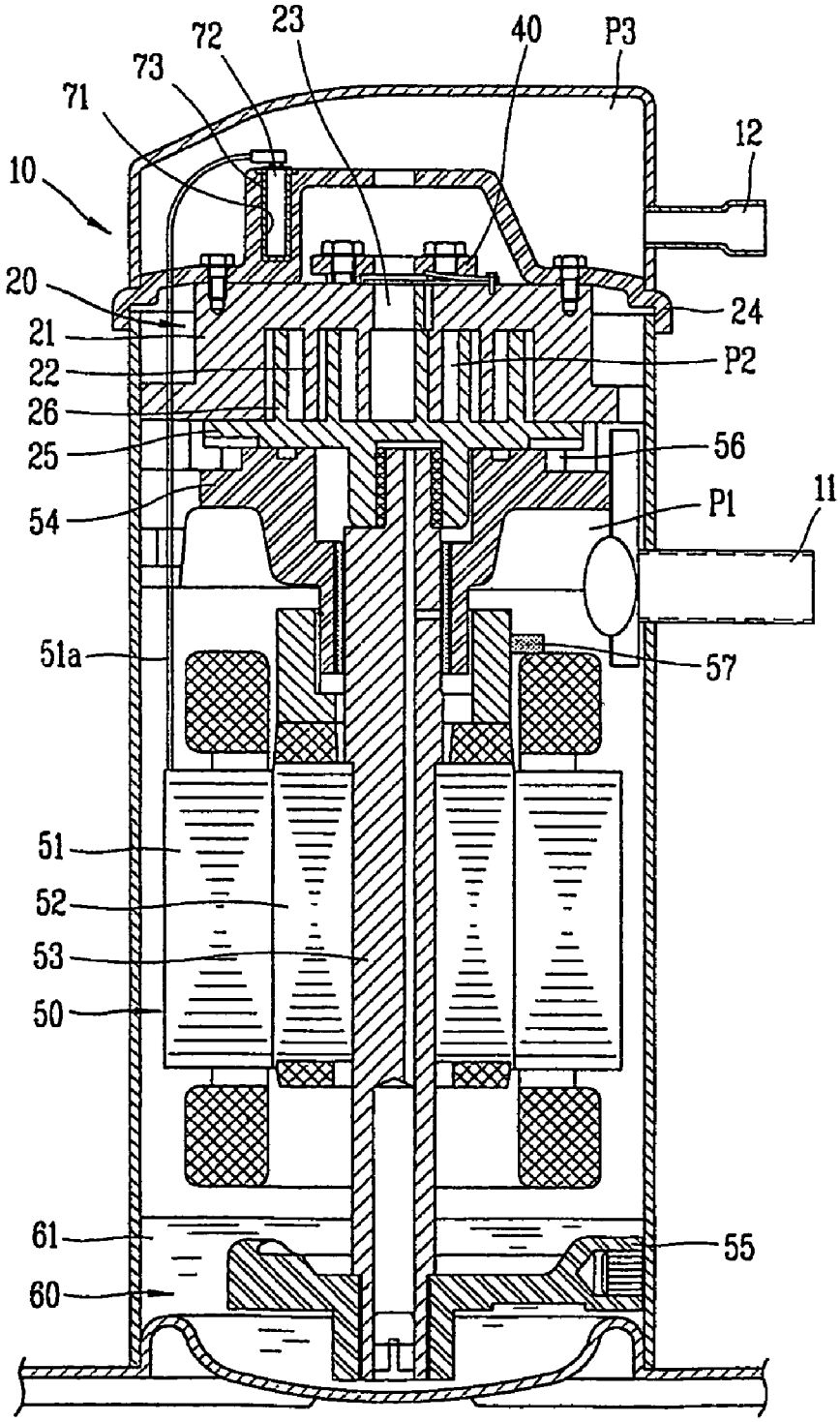
FIG. 1 is a longitudinal sectional view of a compressor in accordance with the present invention.

As shown in FIG. 1, the scroll compressor includes: a casing 10 having a sealed space therein; a compression unit 20 installed inside the casing for compressing fluid; an electric mechanism unit 50 for providing driving force to the compression unit 20; and a lubrication unit 60 for allowing the electric mechanism unit 50 and the compression unit 20 to smoothly operate.

At one side of the casing 10, a suction pipe 11 for sucking fluid from outside and a discharge pipe 12 for discharging the compressed fluid are installed.

The compression unit 20 includes a fixed scroll 21 having a discharge passage 23 for discharging compressed fluid at the central portion with a fixed scroll wrap 22 in an involute shape and being fixedly mounted inside the casing 10; and an orbiting scroll 25 having an orbiting scroll wrap 26 in a involute shape corresponding to the fixed scroll wrap 22 and being mounted to form four compression spaces P2 in a crescent space as the fixed scroll wrap 22 and the orbiting scroll wrap 26 are engaged with an angular difference of 180°.

A high/low pressure separating plate 24 is installed at an upper side of the fixed scroll 21 to section the inner space of the casing 10 into a high pressure side P3 and a low pressure side P1 and form a discharge side muffler at an upper side of the discharge passage 23.

A check valve 40 is mounted at an upper side of the discharge passage 23 to prevent the fluid from flowing backward and introduction of the compressed fluid at the high pressure side P3 into the compression space P2.

The electric mechanism unit 50 includes: a stator 51 fixed inside the casing 10, a rotor 52 for converting electric force to a rotating force in the stator 51, a rotational shaft 53 for transmitting the rotating force of the rotor 52 to the orbiting scroll 25, an Oldham ring 56 mounted between the rotational shaft 53 and the orbiting scroll 25 in order to change the rotational motion of the rotational shaft 53 to an orbiting motion; and a main frame 54 and a lower frame 55 fixedly installed inside the casing 10 in which the rotational shaft 53 is fixed.

The lubrication unit 60 is formed in the rotational shaft 53 and supplies oil 61 filled at the lower portion of the casing 10 to a frictional part inside the casing 10.

The overload protecting device 72 is fixedly installed at the side of the discharge passage 23. As shown in FIG. 1, to facilitate installation of the overload protecting device, a fixing recess 71 is formed at the high/low pressure separating plate 24 and the overload protecting device 72 is installed in the fixing recess 71.

Figure 2:
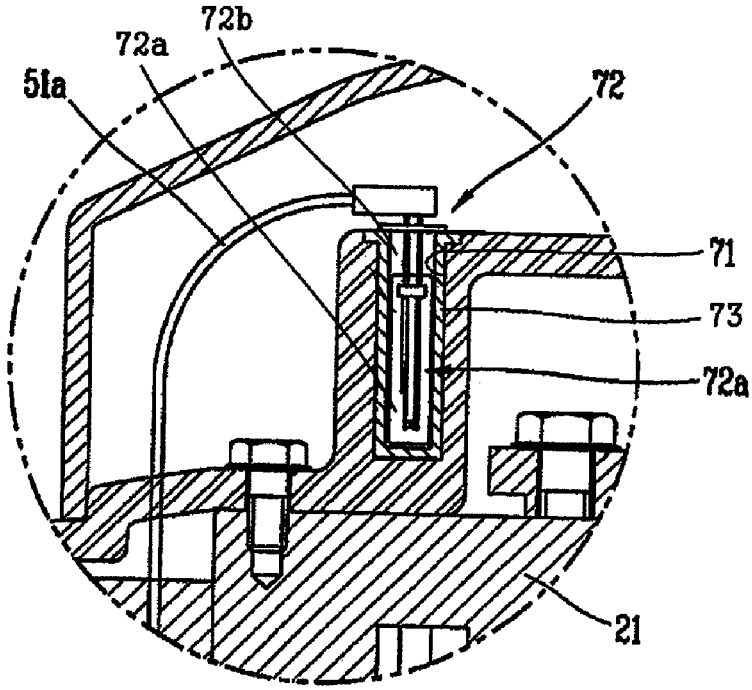
FIG. 2 is a partial detailed view showing a construction of an overload preventing unit of FIG. 1.

With reference to FIGS. 1 and 2, the overload protecting device 72 is connected to a winding coil 51*a* of the electric mechanism unit 50 and senses a temperature of a compressed fluid being discharged to the discharge passage 23. If the sensed temperature is higher than a pre-set value, the connection of the winding coil is cut off to stop operation of the electric mechanism unit 50. Then, the operation of the compressor is stopped, and accordingly, the electric mechanism unit 50 and the compressor are protected. In order to prevent flowing electricity to other members, an insulation member 73 is preferably installed inside the fixing recess 71.

In particular, as shown in FIG. 2, the overload protecting device 72 includes a bimetal switching element 72*a* installed at the muffler and a terminal element 72*b* for connecting between the motor and the bimetal switching element 72*a*. The bimetal switching element 72*a* may be connected to the winding coil 51*a* and the connection may be cut off at a pre-set temperature. At this time, by using the effect that temperature goes up according to a value of a flowing current, if the flowing current is above a pre-set value, the bimetal switching element 72*a* stops operation of the electric mechanism unit 50 to protect the electric mechanism unit 50.

In addition to the overload protecting apparatus 72, in order to prevent a damage of the electric mechanism unit 50 due to a high heat near the electric mechanism unit 50, a second overload protecting apparatus 57 may be installed at an upper side of the stator 51 in order to measure a heat generated by the stator 51 and the rotor 52 and stop operation of the electric mechanism unit 50 in occurrence of overheat.

In the scroll compressor constructed as described above, the compression space (P2) is formed by the fixed scroll 21 and the orbiting scroll 25 respectively having the involute shaped fixed scroll wrap 22 and orbiting scroll wrap 26. The fixed scroll 21 is fixed and the orbiting scroll 25 makes an orbiting motion along a circle with a certain radius in a state that it is fixed not to be rotated, in order to continuously compress the fluid.

As compression proceeds, the check valve 40 opens the discharge passage 23 due to a pressure difference, the compressed fluid flows to the high pressure side P3 through the discharge passage 23, the compressed fluid of the high pressure side P3 is discharged to outside the casing 10 through the discharge pipe 12.

Figure 3A:
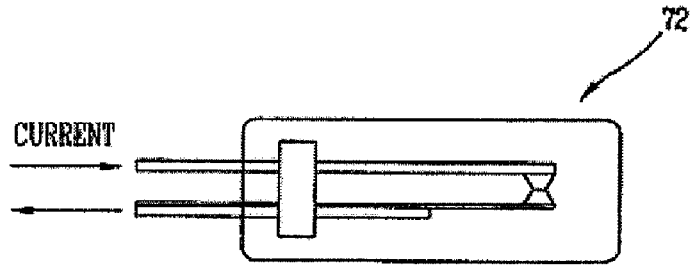
FIGS. 3A and 3B show operation of the compressor in accordance with the present invention.
Figure 3B:
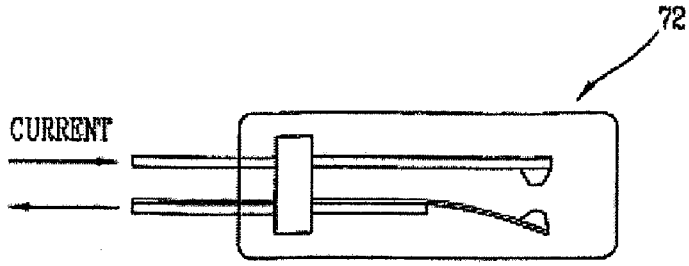

At this time, the overload protecting device 72 is connected to the winding coil 51*a* wound at the stator 51, and if a temperature of the compressed fluid at the high pressure side P3 is below a pre-set temperature, the overload protecting device 72 mounted at the fixing recess 71 of the high/low pressure separating plate 24 is maintained at the connection state as shown in FIG. 3A. Meanwhile, if the compressed fluid has a temperature higher than the pre-set temperature, the winding coil 51*a* is disconnected to prevent an overload of the electric mechanism unit 50, as shown in FIG. 3B.

Besides, if the current flow along the winding coil 51*a* of the electric mechanism unit 50 is above the pre-set value, the winding coil 51*a* is disconnected owing to the heat generated according to the current flow, thereby preventing an overload.

In this manner, the overload protecting apparatus for a compressor has such a structure that the temperature of the fluid discharged to the high pressure side P3 after being compressed in the compression unit is detected for preventing an overload, so that it can cope with an overheat of the compressor due to an abnormal operation.

Especially, in the scroll compressor having the high/low pressure separating plate separating into the high pressure side P3 and the low pressure side P1, if the overload protecting apparatus is installed in the vicinity of the electric mechanism unit as in the conventional art, it is not possible to detect an excessive increase in the temperature of a discharged fluid due to an abnormal operation, failing to quickly cope with the overheat of the compressor. But in the case of the scroll compressor having the high/low pressure separating plate separating into the high pressure side P3 and the low pressure side P1 in accordance with the present invention, an excessive increase in the temperature of the discharged fluid due to an abnormal operation can be detected, so that it can quickly cope with the overheat of the compressor.

INDUSTRIAL APPLICABILITY

As so far described, the compressor of the present invention has many advantages.

That is, for example, first, if fluid is compressed in an overheated state due to an overheat of a motor, etc., the discharged fluid has an excessively high temperature. Then, by stopping the operation of the compressor, the compressor can be prevented from breaking down.

In addition, if the temperature of the discharged fluid after being compressed increases due to an abnormal operation, the compressor is stopped from operating, so that oil carbonization of oil or damage to parts according to melting can be prevented.

Moreover, temperature increase of the fluid discharged after being compressed due to an over-compression in or leakage from the compression unit can be prevented.

Furthermore, the compressor can quickly cope with an overheat or an over-compression inside the casing, so that leakage of the fluid is prevented and thus a reliability can be improved.

The invention claimed is:

1. A compressor comprising:

a suction unit for sucking fluid;

a compression unit for compressing the fluid sucked through the suction unit;

a discharge unit for discharging the fluid compressed in the compression unit;

an electric mechanism unit connected to the compression unit for driving the compression unit;

an overload protecting apparatus including a bimetal switching element installed at the discharge unit and a terminal element for connecting between a motor and the bimetal switching element, the bimetal switching element for stopping operation of the electric mechanism unit if a temperature of the fluid discharged through the discharge unit is higher than a pre-set temperature, and for stopping operation of the electric mechanism unit if a current flow through the bimetal switching element is higher than a pre-set value; and a casing for receiving the compression unit and the motor, wherein a muffler for preventing noise is housed inside the casing and has a top wall separated from the top of the casing at the discharge unit, and a fixing recess is formed in the muffler to receive the overload protecting apparatus therein, wherein the bimetal switching element is received in the fixing recess, and wherein the fixing recess has a certain depth from an upper surface of the muffler to completely receive the overload protecting apparatus.

2. The compressor of claim 1, wherein said compression unit including a high/low pressure separating plate installed in the casing and sectioning a high pressure side and a low pressure side, a fixed scroll coupled to the high/low pressure separating plate and fixedly installed in the casing, and an orbiting scroll for forming a plurality of compression chambers by overlapping with the fixed scroll and making an orbiting motion by being connected to the electric mechanism unit.

3. The compressor of claim 1, wherein the overload protecting apparatus is connected to a winding coil of the electric mechanism unit so that if a current flow in the winding coil is above a pre-set value, the overload protecting apparatus stops operation of the electric mechanism unit.

4. The compressor of claim 1, further comprising:

an insulation member for an insulation with the muffler installed at the inner side of the fixing recess.

5. The compressor of claim 1, wherein the liquid enters the muffler through a first opening and exits the muffler through a second opening into a chamber in the casing, the chamber having a discharge pipe for discharging the liquid from the compressor.

6. A compressor comprising:

a suction unit for sucking fluid;

a compression unit for compressing the fluid sucked through the suction unit;

a discharge unit for discharging the fluid compressed in the compression unit;

an electric mechanism unit connected to the compression unit for driving the compression unit;

an overload protecting apparatus including a bimetal switching element installed at the discharge unit and a terminal element for connecting between a motor and the bimetal switching element, the bimetal switching element for stopping operation of the electric mechanism unit if a temperature of the fluid discharged through the discharge unit is higher than a pre-set temperature, and for stopping operation of the electric mechanism unit if a current flow through the bimetal switching element is higher than a pre-set value; and a casing for receiving the compression unit and the motor, wherein a muffler for preventing noise is housed inside the casing and has a top wall separated from the top of the casing at the discharge unit, and a fixing recess is formed in the muffler to receive the overload protecting apparatus therein, wherein an insulation member for insulating the overload protecting apparatus and the muffler from each other is installed at an inner side of the fixing recess, wherein the bimetal switching element is received in the fixing recess, and wherein the fixing recess has a certain depth from an upper surface of the muffler to completely receive the overload protecting apparatus.

7. The compressor of claim 6, wherein said compression unit including a high/low pressure separating plate installed in the casing and sectioning a high pressure side and a low pressure side, a fixed scroll coupled to the high/low pressure separating plate and fixedly installed in the casing, and an orbiting scroll for forming a plurality of compression chambers by overlapping with the fixed scroll and making an orbiting motion by being connected to the electric mechanism unit.

8. The compressor of claim 6, wherein the overload protecting apparatus is connected to a winding coil of the electric mechanism unit so that if a current flow in the winding coil is above a pre-set value, the overload protecting apparatus stops operation of the electric mechanism unit.

9. The compressor of claim 6, wherein the liquid enters the muffler through a first opening and exits the muffler through a second opening into a chamber in the casing, the chamber having a discharge pipe for discharging the liquid from the compressor.

* * * * *